US006318556B1

(12) United States Patent
Lambert

(10) Patent No.: US 6,318,556 B1
(45) Date of Patent: Nov. 20, 2001

(54) O-RING SEALED BAKABLE TRAYS

(75) Inventor: Donald L. Lambert, Milpitas, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/594,154

(22) Filed: Jun. 15, 2000

(51) Int. Cl.[7] ..... B65D 21/02
(52) U.S. Cl. ..... 206/509; 206/821
(58) Field of Search ..... 220/366.1, 378, 220/806, 795; 206/821, 509; 215/274

(56) References Cited

U.S. PATENT DOCUMENTS

| | | | | |
|---|---|---|---|---|
| 1,985,904 | * | 1/1935 | Murch | 220/366.1 |
| 4,231,489 | * | 11/1980 | Malone | 220/304 |
| 4,706,839 | * | 11/1987 | Spence | 220/315 |
| 5,303,824 | * | 4/1994 | Kohn | 206/449 |
| 5,390,811 | | 2/1995 | Ogino et al. . | |
| 5,520,302 | * | 5/1996 | Anderson et al. | 220/800 |
| 5,644,899 | | 7/1997 | Truesdale . | |
| 5,788,112 | * | 8/1998 | Bacon et al. | 220/611 |
| 5,862,928 | * | 1/1999 | Breuer et al. | 215/350 |
| 6,003,674 | | 12/1999 | Brooks . | |

FOREIGN PATENT DOCUMENTS

| | | |
|---|---|---|
| 32770 | 3/1958 | (CH) . |
| 812501C | 9/1951 | (DE) . |

* cited by examiner

*Primary Examiner*—Stephen Castellano
(74) *Attorney, Agent, or Firm*—McDermott, Will & Emery

(57) ABSTRACT

In order to simplify the process of preparing and packaging of semiconductor chips and the like type of items for transport to customers who use the items in the production of larger devices such as computers and the like, the items are placed in the trays. An o-ring or the like type of gasket is disposed between each of the trays (wherein the upper tray acts as lid for the lower one). This resilient member has a predetermined shape/configuration which maintains a gap or non-sealing condition between the trays sufficient to permit moisture to escape from the trays during baking in an oven. When the interiors of the trays are desiccated, the upper tray is strapped down on the lower tray or trays, with sufficient force as to be deform the gasket to the degree that a hermetic seal is produced at each interface. Stacks of trays can be baked, desiccated, cooled in a dry/desiccated atmosphere, and then strapped together to cause each container to become hermetically sealed.

5 Claims, 8 Drawing Sheets

High Temp O-Ring
~150 Degrees Celsius

Small ridges under non-compressed O-ring to enable air/moisture to flow. When two trays are strapped together, the O-ring will create an air / moisture tight seal.

Multiple trays stacked together: The top tray acts as a lid for the next lower tray. There is an empty tray on top of each stack of trays.

O-RING SEALED BAKABLE TRAYS

FIELD OF THE INVENTION

The present invention relates generally to containers for shipping electronics parts such as microchips and the like from a point of manufacture to a point of assembly into larger, more complex devices such as computers and the like. More specifically, the present invention relates to a tray arrangement which facilitates desiccation of the interior and/or the contents of the tray(s).

RELATED ART

In order to prepare semiconductor devices/items for shipping to a production facility wherein larger, complex electronic devices such as computers, control/guidance circuits and the like type of arrangements are assembled/built, it is necessary to thoroughly desiccate the items and/or the tray in which they are disposed (via an oven bake) strap the trays closed, seal the closed trays in bags or the like which are flushed with clean dry air, and then pack/support the bags in special containers which are also sealed and flushed.

This procedure involves a number of steps and different equipment including sources of dry clean gas (e.g. nitrogen) which can be used to flush out ambient air and to fill the bags/containers with a medium which ensures that the desiccated semiconductor items will remain free of moisture/contamination which may lead to deterioration/spoilage during transport and/or subsequent storage.

This method of packing/handling, however, increases the cost of the items inasmuch as much of the work involved is labor intensive and adds to the overall time involved in the producing and shipping the devices to customers.

SUMMARY OF THE INVENTION

The present invention is directed to overcoming the above-mentioned drawbacks and to abbreviating the packaging process so that items to be shipped can be desiccated in situ in the trays they are to be shipped in and quickly and easily sealed after the desiccating procedures have been completed.

In brief, in order to simplify the process of preparing and packaging of semiconductor chips and the like type of items for transport to customers who use the items in the production of larger devices such as computers and the like, the items are placed in the trays. An o-ring or the like type of gasket is disposed between adjacent trays (wherein the upper tray acts as lid for the lower one). This resilient member has a predetermined shape/configuration which maintains a gap between the trays sufficient to permit moisture to escape from the trays during baking in an oven. When the interiors of the trays are desiccated, the upper tray is strapped down on the lowers tray or trays, with sufficient force to deform the gasket to the degree that a hermetic seal is produced at each tray interface.

Stacks of trays can be thus baked, desiccated, cooled in a dry/desiccated atmosphere, and then strapped together to cause all but the upper tray to become hermetically sealed.

It is further possible with the invention to strap the trays shut while they are still warm, thus ensuring that when the stack cools to ambient temperature, the pressure within the sealed trays will be slightly sub-atmospheric thus obviating the need to evacuate same in the separate time consuming and cost inducing step.

To simplify the number of elements/parts which are necessary, it is deemed advantageous to use only trays and to leave the uppermost tray empty and use it only as a lid. This means that a lid or lids need never be searched for or provided in storage along with the trays. The reduction in invisible costs, inventory and associated costs are also benefits of using only trays in the stacks.

More specifically, a first aspect of the invention resides in a container arrangement for transporting items in a sealed desiccated condition, comprising: a first tray adapted to receive at least one item; a second tray which is adapted to seat on the first tray in a manner to close the upper open end of the first tray; a gasket member disposed between the first and second trays, the gasket having a predetermined configuration which: a) separates the first and second trays to the degree that fluid communication between the interior of the first tray and the ambient surroundings is facilitated, when a force less than a predetermined magnitude that required to deform and flatten the gasket, is applied to the second tray in a manner which tends to reduce the distance between first and second trays, and b) hermetically seals the interior of the second tray from the ambient atmosphere when a force having a magnitude equal to or greater than the predetermined magnitude, is applied to the second tray in a manner which reduces the distance between first and second trays.

In this arrangement the second tray is optionally replaced with a lid member. The first and second trays are so shaped and arranged to as to enable stacking one on the other.

A second aspect of the present invention resides in a method of desiccating an interior of a container arrangement comprising a stack of trays, comprising the steps of: maintaining a predetermined gap between each tray by interposing a gasket which has a predetermined configuration, between each of the trays; heating the interior of the stack of trays to expel moisture from the interior of the trays; compressing the gasket by pressing the trays together so as to deform the gasket and to establish a hermetic seal between each of the trays; and strapping the trays together thus maintaining the compression of each gasket and the formation of each hermetic seal.

This method can further comprise the step of cooling the stack of trays in a desiccating environment before the steps of pressing and strapping.

A further aspect of the invention resides in a method of desiccating an interior of a plurality of stacked trays comprising the steps of: disposing a gasket having a predetermined shape between each of the stacked of trays and maintaining, using the gasket, a clearance between the trays sufficient to permit fluid communication between an interior of each of the trays and the ambient surroundings; disposing the stack of trays in an oven and heating the interior of the trays to expel moisture therefrom; removing the stack of trays from the oven and strapping the stack in a manner which presses the stack together and compress each of the gaskets in a manner which establishes a hermetic seal between each tray.

This method can further comprise the step of allowing the stack of trays to cool in a desiccating environment prior to the step of strapping. The method also features the step of using an uppermost tray as a lid for the stack of trays therebelow.

Yet another aspect of the invention resides in a gasket for use with a container arrangement including a lid and a tray which is closed by the lid, or a stack of trays wherein each upper tray act as a lid for the next lower tray, comprising: an O-ring having shaped portions which, when a predetermined amount of force biasing the lid toward the tray is absent, separate the lid and the tray and provide fluid communication between an interior of the tray and surrounding atmosphere, and which when the predetermined force is applied to bias the lid toward the tray, deform, prevent the fluid communication, and enable the O-ring to establish a hermetic seal between the lid and the tray.

In accordance with this aspect of the invention the shaped portions of the O-ring comprise ribs which are formed intermittently along the length of the O-ring and which, until deformed by the predetermined force, separate the lid and the tray and provide gaps through which fluid flow is possible. Alternatively, the O-ring can have an essentially serpentine configuration and be such that the shaped portions comprise curved portions of the essentially serpentine configuration which exist in the O-ring before the predetermined force is applied.

BRIEF DESCRIPTION OF THE DRAWINGS

The various merits and advantages of the present invention will become more clearly appreciated as a description of the preferred embodiments and structures associated therewith, are given with reference to the appended drawings wherein:

FIGS. 13–17 are views showing another embodiment of the invention wherein FIG. 13 is a schematic side view, FIG. 14 is a schematic top plan view, FIG. 15 is an enlarged schematic view of the section enclosed in the rectangle R of FIG. 14; FIG. 16 is an enlarged schematic view of a portion of the O-ring enclosed in rectangle S of FIG. 15; and FIG. 17 is a schematic side view showing a stack of trays wherein the uppermost tray becomes the lid for the tray immediately therebelow.

DETAILED DESCRIPTION OF THE PREFERRED EMBODIMENTS

Figure 1:
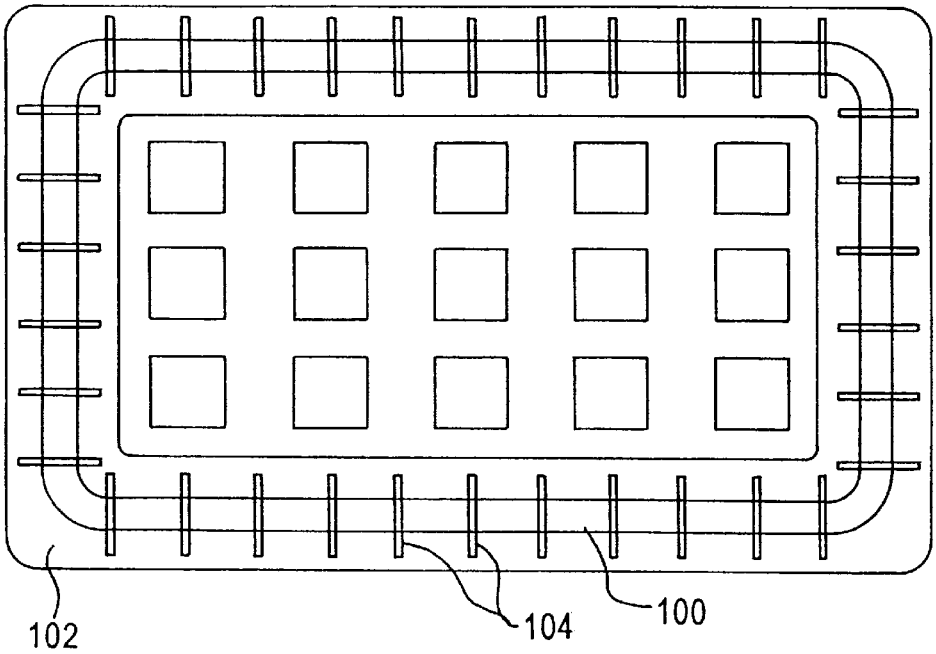
FIG. 1 is a plan view of a tray of which is provided product pockets in which items to be shipped are disposed and which is provided with an O-ring in accordance with a first embodiment of the present invention.
Figure 2:
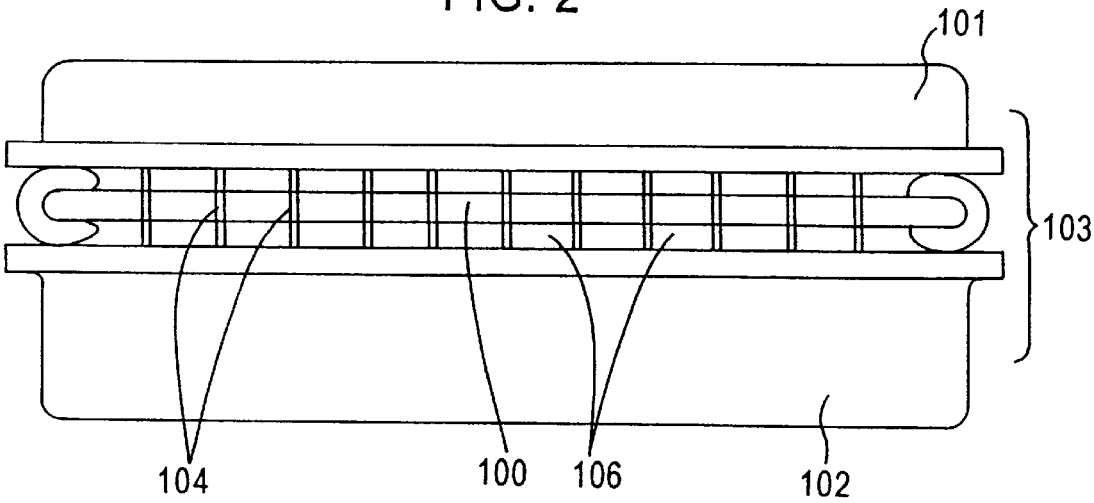
FIG. 2 is a side view of a tray arrangement which in this instance uses a lid, showing a lid placed in position on the tray and wherein the O-ring is insufficiently deformed to prevent fluid communication between the interior of the tray and the ambient surroundings.
Figure 3:
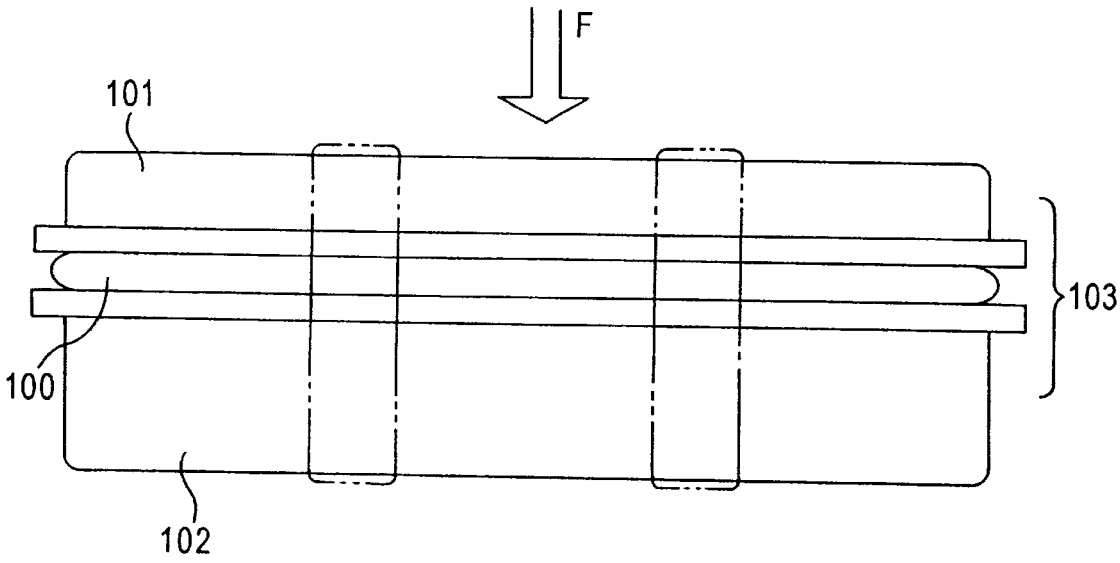
FIG. 3 is side view showing the tray arrangement in a state wherein the lid is pressed down on the tray with sufficient force as to deform the O-ring and to establish a hermetic seal between the lid and the tray.

FIGS. 1–6 show a first embodiment of the invention. In this arrangement, a gasket 100 which takes the form of a ribbed O-ring is disposed between the lid 101 and tray 102 of a container arrangement 103 which is arranged to receive semiconductor components or the like.

It will be understood that the "lid 102" which is referred to in connection with the description of the container arrangement 103, can be a separate lid element in the illustrated manner or, more advantageously another tray. Thus, even though the tray and lids are referred to as being separated elements they may, as pointed out above, be all of the same structure and arrangement and used so that, when stacked, the uppermost tray is left empty and merely functions as the "lid" which is referred to throughout this disclosure in connection with the element designated by numeral 101.

It should, however, be appreciated, the invention may, due to the unique characteristics of the gasket/O-ring, be used in a situation wherein a tray is provided with a lid, or wherein each of a stack of containers is provided with a lid, and is not necessarily limited to a stack of trays wherein no special lid element or elements is provided.

Figure 4:
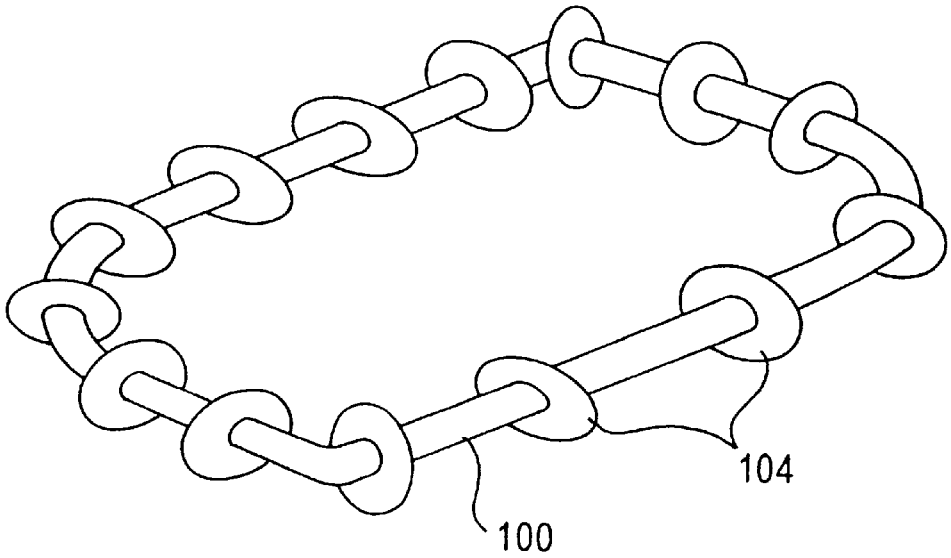
FIG. 4 is a perspective view showing the first embodiment of an O-ring.

As best seen in FIG. 4, the first disclosed embodiment of the O-ring 100 is provided with a plurality of space ribs 104, which in this embodiment have essentially circular disc-like configurations. These ribs 104 are such as to be provided in sufficient number that the resilience of the combined number is such as resist deformation until such time as sufficient force F (see FIG. 3) is applied to the lid 101 to force it down toward the tray 102 in a manner which deforms the O-ring 100 to the condition depicted in FIGS. 3 and 6, for example.

Figure 6:
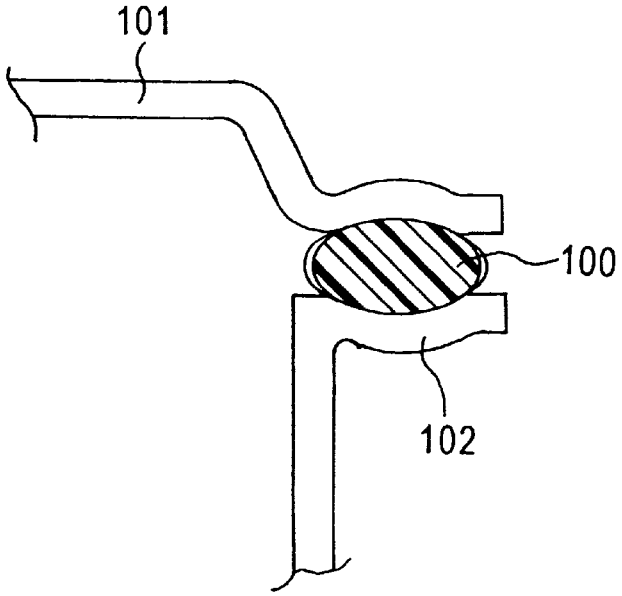
FIG. 6 is a side sectional view similar to that depicted in FIG. 5, but which shows the lid pressed down on the tray in a manner which deforms the O-ring and establishes a hermetic seal.

Thus, until this predetermined force F is applied, the lid 101 is separated from the tray 102 in the manner best seen in FIG. 6, so that the interior of the tray 102 is permitted to fluidly communicate with the surrounding atmosphere. With the lid 101 thus suspended above the tray 102, any moisture or the like which is resident therein can be permitted to vent during a baking process wherein the container arrangement (lid, tray and gasket) 103 are passed through an oven.

By way of example only, this oven can be a radiate or convection oven wherein the trays 102 are exposed to a hot dry environment wherein the temperature is greater than 150° C. for a period of from 2–20 hours. During this period any undesired water and the like, will vaporize and will escape from the tray through the gaps 106 provided between the ribs 104 in the manner schematically illustrated in FIG. 5.

As will be appreciated, after exposure to this type of baking, the interior of the tray 102 will be desiccated to an acceptable level and the container arrangement 103 can be removed from the oven. Following the baking, the desiccated container arrangement 103 can be strapped shut with sufficient force as to press the lid down onto the tray so as to assume the configuration depicted in FIG. 3. Once the straps 108 (shown in phantom in FIG. 3) are in place the container arrangement 103 will remain hermetically sealed through the provision of the O-ring 100 and thus remain desiccated during transport to site wherein the contents thereof will be used in further fabrication/construction operations.

It will of course be appreciated that if the container arrangement 103 is immediately sealed shut after being removed from an oven, an excessively high negative pressure may tend to develop within upon cooling to ambient temperatures and invite crushing by the force applied by the external ambient atmosphere. It is thus advantageous to permit the containers 103 (viz., the trays 102) to cool to within a predetermined temperature range of ambient temperature in a desiccated environment having either an ambient or controlled temperature environment. Once the temperature of container arrangement 103 has lowered sufficiently, it can be strapped shut and permit the remaining cooling to produced an acceptable negative pressure within the container.

Figure 7:
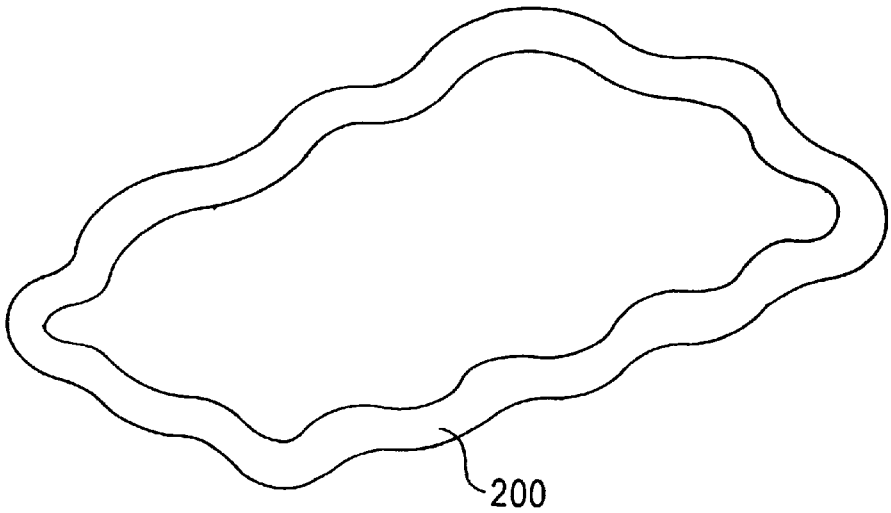
FIG. 7 is a perspective view showing a second embodiment of an O-ring which can be used in accordance with the present invention.
Figure 5:
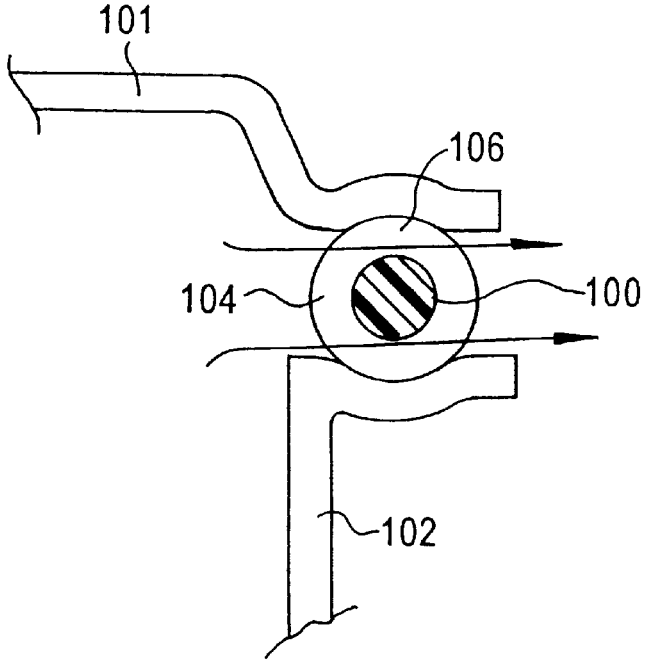
FIG. 5 is a side sectional view which shows the O-ring or gasket of FIG. 4, disposed between the tray and the lid in a manner which provides gaps via which moisture/vapor can be expelled from the trays during a baking/desiccating process.

The shape and arrangement of the O-rings which can be used is not limited to that shown in FIGS. 1–6 and can have a serpentine, rib-free configuration (200) of the nature shown in FIG. 7. This configuration will, given that the elastomer from which is made exhibits the necessary physical characteristics, until the required force F is applied to the lid 101, maintain sufficient spacing and gaps as to allow the venting of water vapor and the like in the same manner as shown in FIG. 5.

Figure 8:
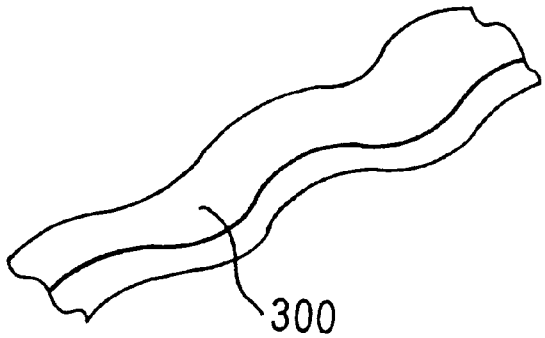
FIG. 8 is a perspective view of a portion of a third embodiment of an O-ring or gasket which can be used in connection with the present invention.
Figure 9:
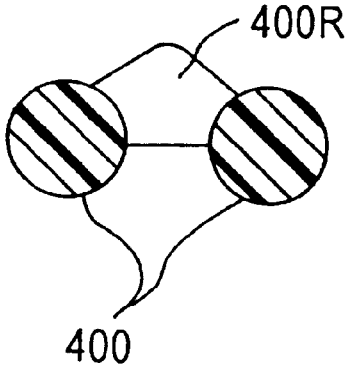
FIG. 9 is a perspective view of a portion of fourth embodiment of an O-ring or gasket which can be used in connection with the present invention.

FIGS. 8 and 9 depict further alternative O-ring configurations which can be considered for use in the manner described above. In FIG. 8, the gasket or O-ring 300 has a flattened cross-section but is provided with a serpentine configuration in a manner similar to that shown in FIG. 7. The arrangement shown in FIG. 9 is more complex featuring two ring members 400 which are interconnected by shaped ribs 400R which are formed at predetermined intervals. The shaped ribs 400R are arranged to maintain the required lid/tray separation until such time as they are deformed via the application of force F.

Through the use of the above-type of gasket/O-ring arrangements it is possible to form a stack of trays wherein the upper tray becomes the lid for the tray immediately therebelow and so that only the upper tray requires a separate closure member. This type of arrangement is schematically depicted on FIGS. 10–12.

Figure 10:
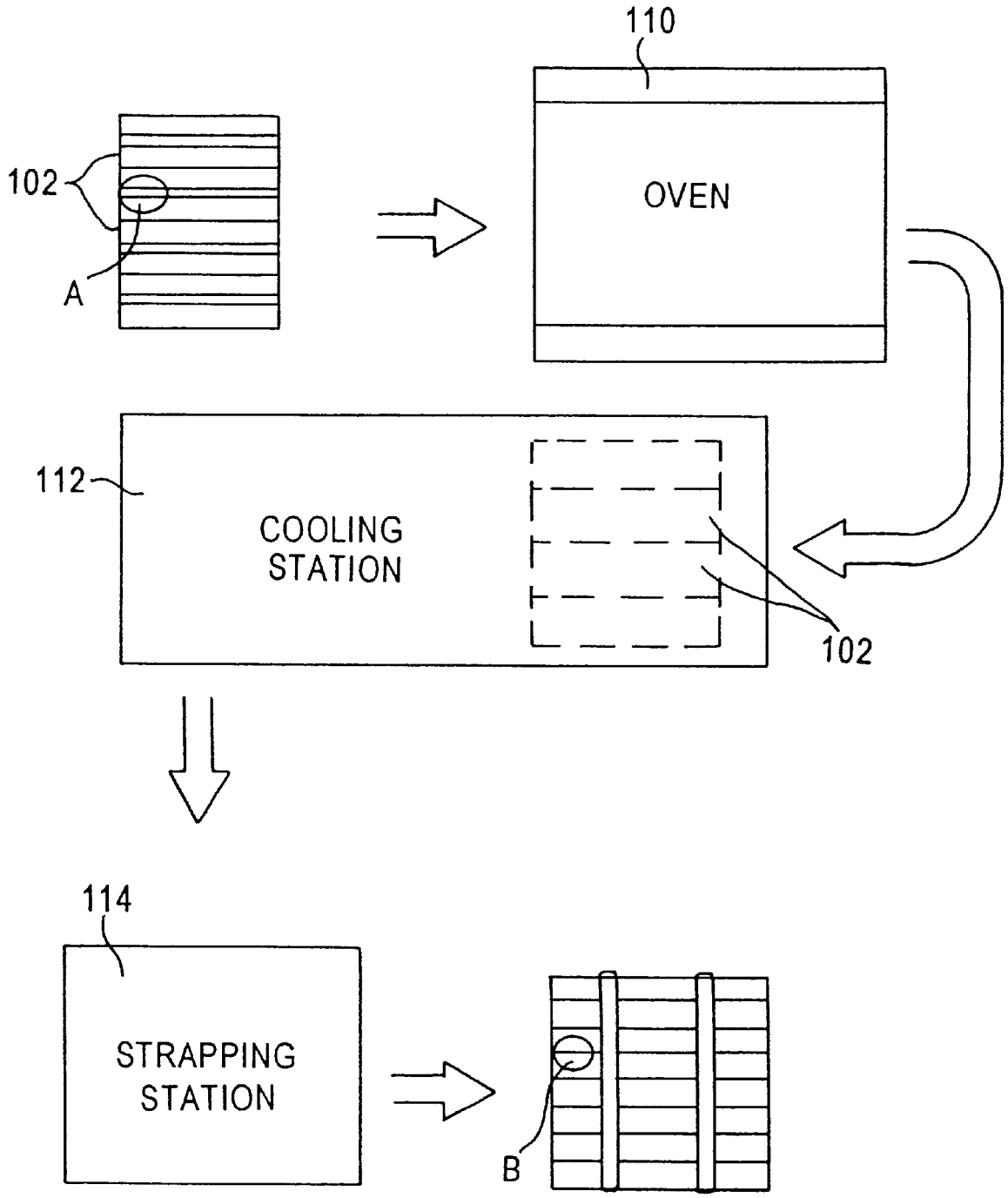
FIG. 10 is a schematic diagram showing the manner in which a stack of trays provided with an O-ring in accordance with the present invention, are passed through an oven, a cooling stage, and a strapping stage.

FIG. 10 also depicts a cycle wherein the trays 102 are stacked, moved into an oven 110 such as a radiant or convection oven, and baked dry. Following this, the stack can be moved into a cooling stage 112 wherein they are permitted to cool in desiccated/desiccating conditions. When the temperature of the trays 102 has reduced to an acceptable level, the stack can be moved to a strapping machine 114 wherein the stack is strapped shut.

Figure 11:
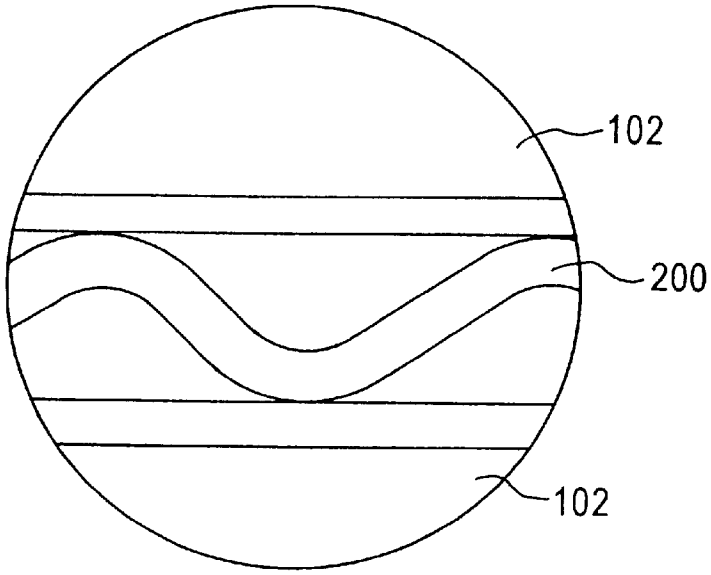
FIGS. 11 and 12 are enlargements of the portions of the tray stack which is located in circles A and B of FIG. 10, depicting the status of the O-ring or gasket prior to desiccation and after strapping and sealing.
Figure 12:
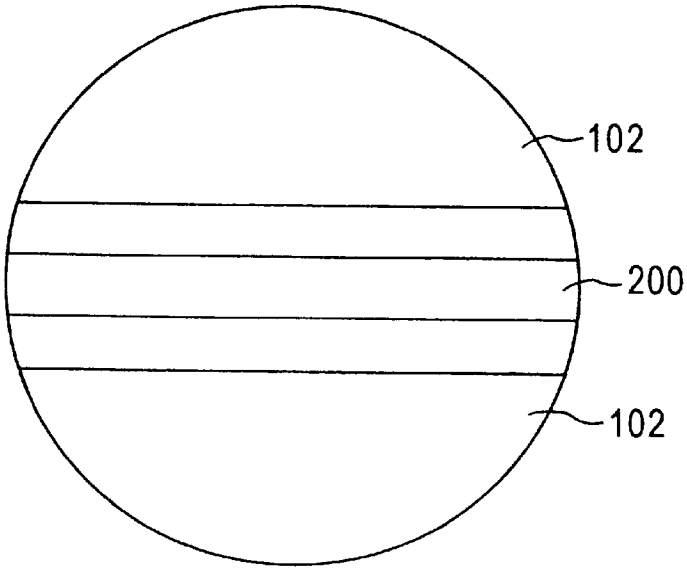
Figure 13:
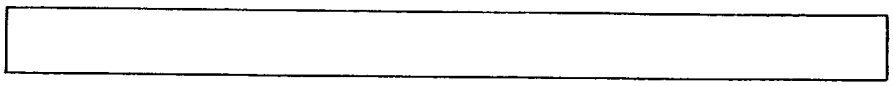
Figure 14:
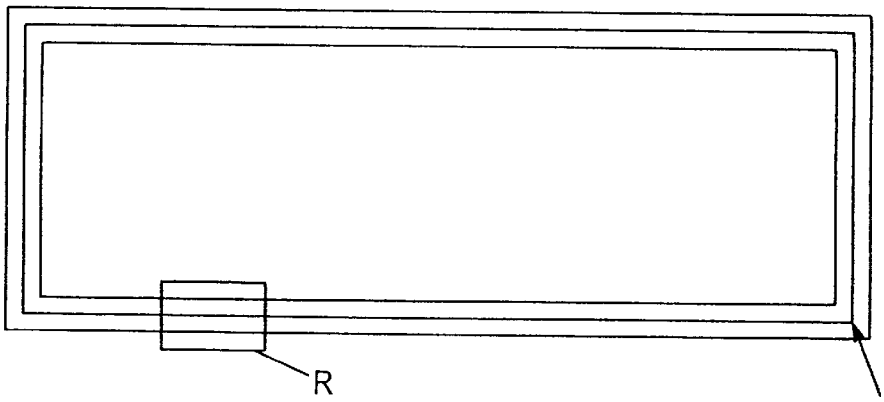

FIGS. 11 and 12 are enlargements of the portions of the stack of trays enclosed in circles A and B, and respectively shown the condition of the O-rings in the stack prior entry into the oven and following strapping. As will be appreciated, the trays 102 which form the stack are each separated by a serpentine shaped O-ring 200 of the type shown in FIG. 7. However, as made clear hereinabove, it is possible to use any suitably configured O-ring as the gasket provided that it provides the required separation in the absence of the force F and deforms into a sealing configuration in response to the above mentioned force application.

The material from which the O-rings are made needs to be resistant to temperatures up to or slightly in excess of 150° C. so as not soften excessively during the baking process.

Figure 15:
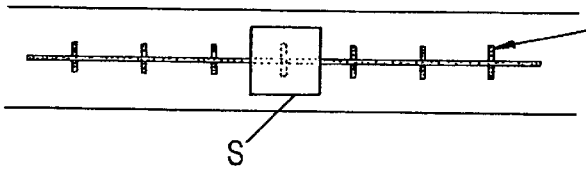
Figure 16:
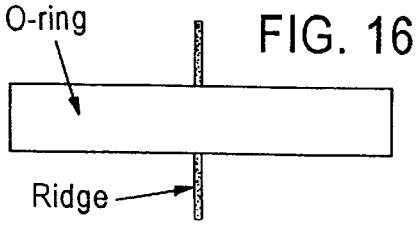
Figure 17:
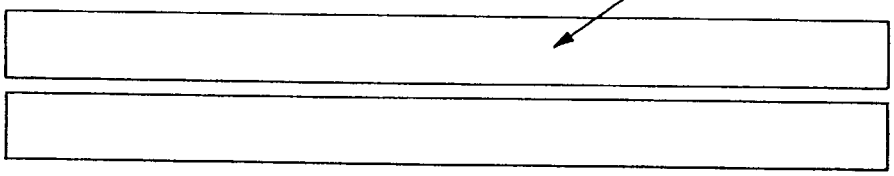

FIGS. 13–17 show another embodiment of the invention. In this arrangement, a high temperature O-ring which is also resistant to temperatures up to or in excess of 150° C. is disposed between each of the plurality of trays which comprise the stack (in this instance only two are shown in FIG. 17). As best seen in FIG. 15, small ridges which are formed in/on the O-ring are arranged so that under non-compressed conditions air/moisture is permitted to flow there past. However, when the trays are strapped together in the manner mentioned above, the O-ring(s) will compress and create an air/moisture tight seal.

In accordance with this embodiment, when multiple trays are stacked together in the manner depicted in FIG. 17, the top tray acts as a lid for the tray thereunder and thus provide the situation wherein there will always be one empty tray on top of the stack.

It is submitted that even though the invention has been described with reference to only a limited number of embodiments, one of skill in the art of packaging will have little or no difficulty, when equipped with the above description of devising various variants and changes which can be adapted to varying needs without inventive effort. For example, the invention is not limited to convection or radiant ovens and the containers are not limited necessarily to the storage of microprocessor or IC components. The O-rings can have a series of through holes formed therein in a manner that they will be squeezed closed in response to application of pressure. The holes can have a rhomboid shape for example, so that they can readily squeeze shut as the compressive forces are applied as a result of strapping. In fact, the invention is limited only by the scope of the appended claims.

What is claimed is:

1. A container arrangement for transporting items for shipping in a sealed desiccated condition comprising:

a least one tray, each tray having an interior and adapted to receive said items;

a lid having an interior; and a gasket member disposed between at least one tray and said lid element, said gasket having a serpentine or a spaced rib configuration in its uncompressed state so as to maintain separation between said tray and said lid to allow fluid communication between the ambient surroundings and the interiors of said tray and said lid, and in its compressed state, forming a hermetically seal between the ambient surroundings and interiors of said tray and said lid.

2. The container arrangement as set forth in claim 1, wherein said lid is a second tray.

3. The container arrangement as set forth in claim 1, wherein said lid is a separate lid element.

4. The container arrangement as set forth in claim 1, wherein two or more trays are stacked one on top of another and a gasket member is disposed between each of said trays, said gasket having a serpentine or a spaced rib configuration in its uncompressed state so as to maintain separation between said trays to allow fluid communication between the ambient surroundings and the interiors of said trays, and in its compressed state, forming a hermetically seal between the ambient surroundings and interiors of said trays.

5. The container arrangement as set forth in claim 4, wherein said trays and lid are strapped together to compress said gaskets.

* * * * *